US005572088A

United States Patent [19]

Aizawa et al.

[11] Patent Number: 5,572,088

[45] Date of Patent: Nov. 5, 1996

[54] COLD-CATHODE FLUORESCENT LAMP

[75] Inventors: Masanobu Aizawa, Iwaki; Masatosi Chiba, Katsushika-ku; Thuneyosi Sibasaki, Iwaki; Mitugi Tayama, Iwaki; Tomohiko Sakamoto, Iwaki; Masalu Ito, Iwaki, all of Japan

[73] Assignee: Stanley Electric Co., Ltd., Tokyo, Japan

[21] Appl. No.: 459,187

[22] Filed: Jun. 1, 1995

[30] Foreign Application Priority Data

Oct. 7, 1994 [JP] Japan ..... 6-268156

[51] Int. Cl.[6] ..... H01J 17/04; H01J 17/24; H01J 17/26

[52] U.S. Cl. ..... 313/491; 313/631; 313/632; 313/558; 313/566

[58] Field of Search ..... 313/491, 490, 313/488, 492, 558, 566, 594, 631, 633, 632

[56] References Cited

U.S. PATENT DOCUMENTS 5,256,935 10/1993 Dobashi ..... 313/491

*Primary Examiner*—Sandra L. O'Shea

*Assistant Examiner*—John Ning

*Attorney, Agent, or Firm*—Weingarten, Schurgin, Gagnebin & Hayes

[57] ABSTRACT

A cold-cathode fluorescent lamp includes an opposing pair of electrodes in spaced relationship in a tubular glass bulb of which the inner wall surface is coated with fluorescent material, and each of the electrodes is divided into four plate-like electrode members each having mercury and getter preliminarily coated thereon while maintaining a necessary area for each electrode without any contact with the inner wall surface of the tubular glass bulb. The opposite ends of the tubular glass bulb are airtightly sealed with beads through which electricity feeding wires extend for feeding electricity to the electrodes while holding the electrodes in the tubular glass bulb. Two of the four plate-like electrode members are located on one side of each electricity feeding wire, while another two of the same are located on the opposite side of the same. The respective plate-like electrode members are spot-welded to each electricity feeding wire. With this construction, the length of each electrode as measured in the axial direction of the tubular glass bulb can be shortened, and moreover, the length of a non-illuminating part of the cold-cathode fluorescent lamp can also be shortened. Consequently, the whole length of the foregoing type of cold-cathode fluorescent lamp can be shortened. Each of the electricity feeding wires may fully be composed of a Dumet wire.

7 Claims, 2 Drawing Sheets

FIG-4
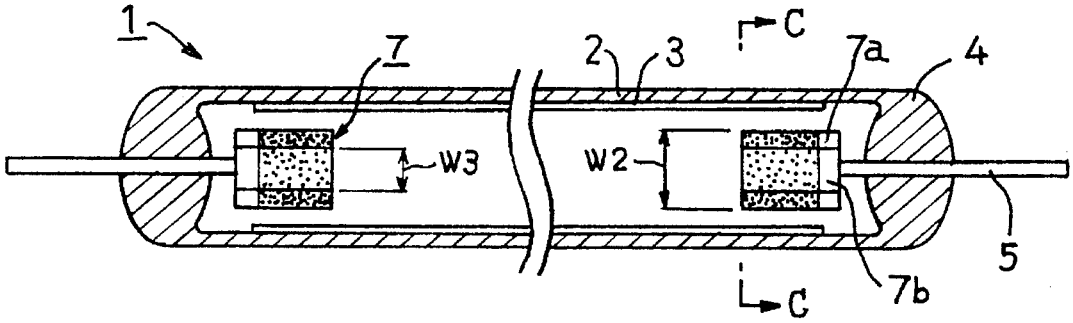
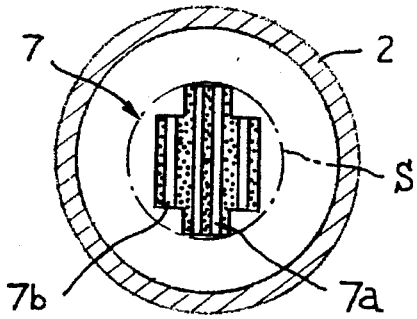
FIG-5
FIG-6
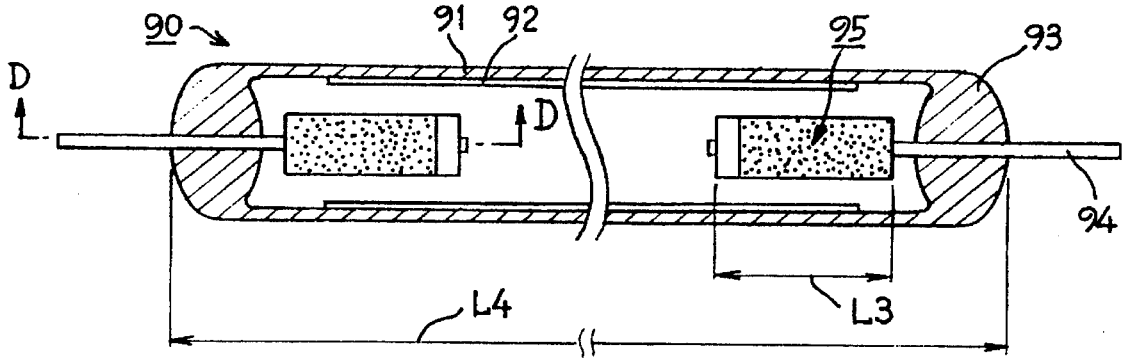
FIG-7
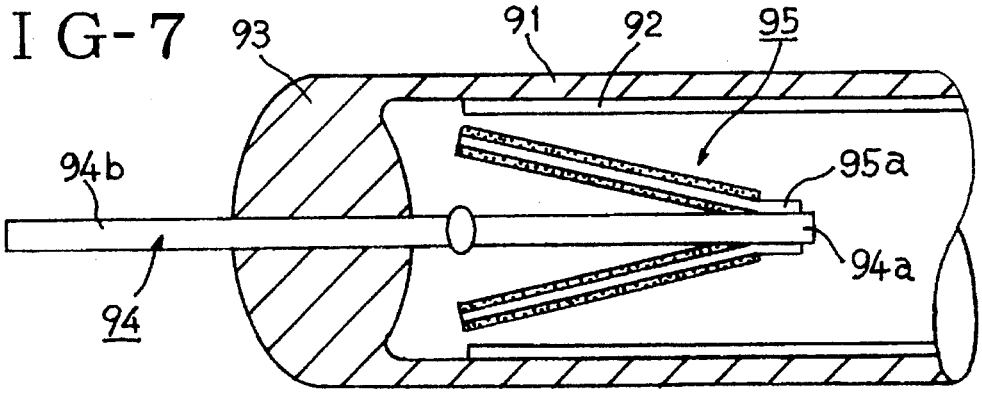

COLD-CATHODE FLUORESCENT LAMP

BACKGROUND OF THE INVENTION

1. Field of the Invention

The present invention relates generally to a cold-cathode fluorescent lamp usable as, e.g., a back-light unit for a liquid crystal displaying device. More particularly, the present invention relates to a cold-cathode fluorescent lamp of the foregoing type which assures that a rate of an effective illuminating length of the cold-cathode fluorescent lamp as measured in the axial direction of the latter to the whole length of the same can be improved, and moreover, a yielding rate of the cold-cathode fluorescent lamp produced via a number of production steps can be improved.

2. Background Art

To facilitate understanding of the present invention, a typical conventional cold-cathode fluorescent lamp will be described below with reference to FIG. 6 and FIG. 7. Specifically, FIG. 6 and FIG. 7 show by way of example the structure of a conventional cold-cathode fluorescent lamp 90. The cold-cathode fluorescent lamp 90 includes a tubular glass bulb 91 of which the inner wall surface is coated with a fluorescent material 92 and of which the opposite ends are airtightly sealed with beads 93. Electricity feeding wires 94 extend through the beads 93 so as to enable an opposing pair of electrodes 95 to be held in the tubular glass bulb 91 in the spaced relationship.

Here, each of the electrodes 95 will be described in more detail with reference to FIG. 7 which is a fragmentary enlarged sectional view. As shown in FIG. 7, each electrode 95 is composed of two rectangular plate-like electrode members 95*a* each of which is preliminarily coated with mercury and getter while maintaining a necessary area. The two plate-like electrode members 95*a* are affixed to the innermost ends of the electricity feeding wires 94 on the discharging chamber side by employing a spot welding process while they are slantwise parted away from each other in the radial direction.

The innermost end part of each electricity feeding wire 94 is exposed to the discharging chamber side to bear part or all of a discharging load in the tubular glass bulb 91. To assure that a malfunction of spattering does not occur when the fluorescent lamp is turned on, the foremost end part of each electricity feeding wire 94 is composed of a nickel wire 94*a* having excellent stability, and the remaining part of each electricity feeding wire 94 extending through the bead 93 is composed of a Dumet wire 94*b* having an expansion coefficient approximate to that of glass. A Dumet wire is a wire formed of Fe–Ni alloys containing approximately 42% Ni, the surface of which is covered with copper. The nickel wire 94*a* and the Dumet wire 94*b* are connected to each other at a certain adequate position on the electricity feeding wire 94 by employing a welding process.

When the conventional cold-cathode fluorescent lamp 90 constructed in the above-described manner is used as a back-lighting unit for a liquid crystal displaying device, it is required that the tubular glass bulb 91 be dimensioned to have a very small size represented by an outer diameter of, e.g., about 3 mm and an inner diameter of, e.g., about 2 mm. In view of the foregoing fact, to assure that each plate-like electrode member 95*a* has a necessary area, it is naturally unavoidable that a length L3 of each electrode 95 as measured in the axial direction of the tubular glass bulb 91 is elongated.

At this time, discharging is effected within the range defined by a shortest distance between both the electrodes 95 located opposite to each other in the tubular glass bulb 91. Thus, the longer the length L3 of each electrode 95, the larger the non-illuminating part of the cold-cathode fluorescent lamp 90. Consequently, a rate of the effective illuminating length of the cold-cathode fluorescent lamp 90 to a total length L4 of the same is reduced.

When the cold-cathode fluorescent lamp 90 is used as a back-lighting unit for a liquid crystal displaying device, illuminating should be effected within the range defined by the foregoing effective illuminating length. Thus, the longer the length L3 of each electrode 95, the longer the total length L4 of the cold-cathode fluorescent lamp 90. Consequently, there arises a problem that the backlighting unit is designed and constructed with large dimensions, causing, e.g., a portable type electronic device apparatus having the foregoing type of liquid crystal displaying device employed therefor to be correspondingly designed and constructed with large dimensions.

In addition, when each plate-like electrode member 95*a* is spot-welded to the electricity feeding wire 94, there is a tendency that free ends of the plate-like electrode members 95*a* are expansively parted away from each other. At this time, when the length L3 of each electrode 95, i.e., each plate-like electrode member 95*a* is long, a quantity of expansive displacement of the plate-shaped electrode members 95*a* in that way is increased so that the electrode 95 is liable to come in contact with the inner wall surface of the tubular glass bulb 91.

As is well known in the art, after both the beads 93 of the cold-cathode fluorescent lamp 90 are airtightly sealed, it is necessary that mercury vapor is emitted from the electrodes 95 and the getter is activated by heating the electrodes 95 with electric current having a high frequency. However, when the electrodes 95 are heated with electric current having a high frequency while they are brought in contact with the inner wall surface of the tubular glass bulb 91, thermal energy generated from each electrode 95 at about 850° C. is transmitted to the tubular glass bulb 91. Consequently, there arises a problem that the tubular glass bulb 91 cracks, resulting in the yield rate of product of cold-cathode fluorescent lamps being reduced. Further, since each electricity feeding wire becomes complicated in structure, there arises another problem that the product of cold-cathode fluorescent lamps is produced at an increased cost. In the circumstances as mentioned above, many requests have been hitherto raised from users for solving the aforementioned problems.

SUMMARY OF THE INVENTION

The present invention has been made in consideration of the aforementioned background.

An object of the present invention is to provide a cold-cathode fluorescent lamp which assures that the length of the cold-cathode fluorescent lamp as measured in the axial direction can substantially be shortened compared with that of the conventional cold cathode fluorescent lamp.

Another object of the present invention is to provide a cold-cathode fluorescent lamp which assures that it can practically be used for a long time without any occurrence of a malfunction of spattering or the like.

According to one aspect of the present invention, there is provided a cold-cathode fluorescent lamp including an opposing pair of electrodes in spaced relationship in a tubular glass of which the inner wall surface is coated with a fluorescent material wherein the cold-cathode fluorescent lamp comprises two electricity feeding wires airtightly extending through beads at the opposite ends of the tubular glass bulb for feeding electricity to the electrodes while holding the electrodes in the tubular glass bulb; and four plate-like electrode members each having mercury and getter preliminarily coated thereon to serve as an electrode and spot-welded to the side surface of each of the electricity feeding wires without any contact with the inner wall surface of the tubular glass bulb while maintaining a necessary area for each of the electrodes, two of the four plate-like electrode members being located on one side of each of the electricity feeding wires, while another two are located on the opposite side of the same, the fore end parts of the plate-like electrode members on the free end side of the latter being bent toward each of the electricity feeding wires to come in contact with the same.

Each of the electrodes exhibits a substantially square contour as viewed in the axial direction.

In addition, each of the electricity feeding wires may fully be composed of a Dumet wire.

Further, according to another aspect of the present invention, there is provided a cold-cathode fluorescent lamp including an opposing pair of electrodes in spaced relationship in a tubular glass tube of which the inner wall surface is coated with a fluorescent material, wherein the cold-cathode fluorescent lamp comprises two electricity feeding wires airtightly extending through beads at the opposite ends of the tubular glass bulb for feeding electricity to the electrodes while holding the electrodes in the tubular glass bulb; and four plate-like electrode members each having mercury and getter preliminarily coated thereon to serve as an electrode and spot-welded to the side surface of each of the electricity feeding wires without any contact with the inner wall surface of the tubular glass bulb while maintaining a necessary area for each of the electrodes, two of the four plate-like electrode members being located on one side of each of the electricity feeding wires and one of the two plate-like electrode members located on the outer side relative to each of the electricity feeding wires having a width smaller than that of the remaining one, while another two are located on the opposite side of the same and one of the two plate-like electrode members located on the outer side relative to each of the electricity feeding wires has a width smaller than that of the remaining one, the four plate-like electrode members extending in parallel not only with each other but also with each of the electricity feeding wires.

The opposite ends of each of the four plate-like electrode members located outside of each of the electricity feeding wires are involved within the range defined by a circle spaced away from the inner wall surface of the tubular glass bulb while coming in contact with the circle when they are viewed in the axial direction.

In this case, each of the electrodes exhibits a substantially plus-marked contour as seen in the axial direction.

Similarly, each of the electricity feeding wires may fully be composed of a Dumet wire.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 4 is a sectional view of a cold-cathode fluorescent lamp constructed in accordance with another embodiment of the present invention;

FIG. 5 is an enlarged cross-sectional view of the cold-cathode fluorescent lamp taken along line C—C in FIG. 4;

FIG. 6 is a sectional view of a conventional cold-cathode fluorescent lamp; and FIG. 7 is a fragmentary enlarged sectional view of the conventional cold-cathode fluorescent lamp taken along line D—D in FIG. 6.

DETAILED DESCRIPTION OF THE PREFERRED EMBODIMENTS

The present invention will be described in detail hereinafter with reference to the accompanying drawings which illustrate preferred embodiments thereof.

Figure 1:
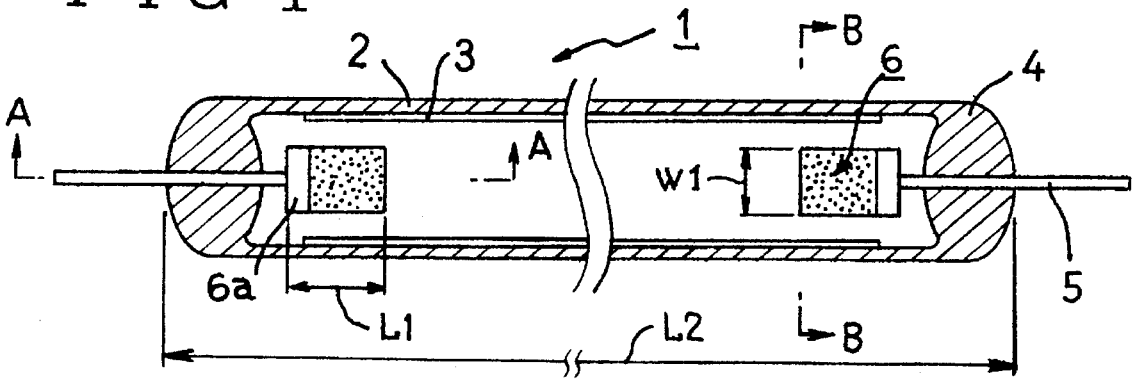
FIG. 1 is a sectional view of a cold-cathode fluorescent lamp constructed in accordance with an embodiment of the present invention.

FIG. 1 shows by way of sectional view the structure of a cold-cathode fluorescent lamp 1 constructed in accordance with an embodiment of the present invention. This cold-cathode fluorescent lamp 1 is the same as the conventional one with respect to the structure of the cold-cathode fluorescent lamp 1 including a tubular glass bulb 2 of which the inner wall surface is preliminarily coated with a fluorescent material 3 and of which opposite ends are airtightly sealed with beads 4, and electricity feeding lines 5 extending through the beads 4 so as to allow an opposing pair of electrodes 6 to be fed with electricity while they are held in the tubular glass bulb 2.

In addition, the cold-cathode fluorescent lamp 1 is the same to the conventional one with respect to the structure of plate-like electrode members *6a* each preliminarily coated with mercury and getter employed for each electrode 6.

In this embodiment, each electrode 6 is substantially equally divided into four electrode segments each having a rectangular contour while maintaining a necessary area for the electrode 6. Since a width W1 of each plate-like electrode member *6a* as measured at a right angle relative to the axial direction of the tubular glass bulb 2 is determined depending on an inner diameter of the tubular glass bulb 2, it is not substantially different from that of the conventional cold-cathode fluorescent lamp. However, since each electrode 6 is divided into four electrode segments in that way, a length L1 of each plate-like electrode member *6a* as measured in the axial direction of the tubular glass bulb 2 is substantially reduced to a half of that of the conventional cold-cathode fluorescent lamp.

Figure 2:
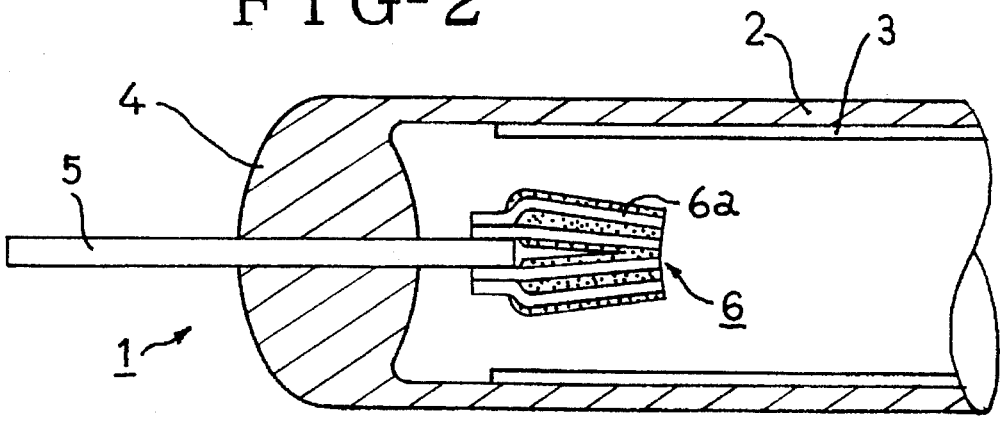
FIG. 2 is a fragmentary enlarged sectional view of the cold-cathode fluorescent lamp taken along line A—A in FIG. 1.

FIG. 2 shows by way of fragmentary enlarged sectional view the structure of each electrode 6 in more detail. Specifically, four divided electrode segments of the plate-like electrode member *6a* are arranged such that among four divided electrode segments, two divided electrode segments are superimposed one above another on one side of the electrode 6 and they are then spot-welded to the opposite side surfaces of each electricity feeding wire 5 at the rear end part of the plate-like electrode member *6a* on the sealed side of the tubular glass bulb 2, i.e., on the foremost end side of the electricity feeding wire 5.

As described above, since the rear end part of the plate-like electrode member 6a on the sealed side is spot-welded to the foremost end part of the electricity feeding wire 5, the electricity feeding wire 5 is not present between adjacent plate-like electrode members 6a at any location other than the location where spot-welding is effected. With such construction, the fore end parts of the plate-like electrode members 6a on the free end side of the latter are brought in contact with each other in the bent state, resulting in a sectional area of each electrode 5 being reduced.

Here, each electricity feeding wire 5 will be described below in more detail. When the cold-cathode fluorescent lamp 1 is turned on, discharging occurs within the range defined by a shortest distance between a pair of electrodes 6 located opposite to each other. Accordingly, the electricity feeding wire 5 spot-welded to the rear end part of the plate-shaped electrode members 6a on the rear end side of the electrode 6 is not entirely associated with an occurrence of discharging. Thus, there does not arise the necessity to take into account a problem of any occurrence of a malfunction of spattering or the like.

In this embodiment, it is sufficient that each electricity feeding wire 5 has acceptable capability of connection only to one bead 4. Thus, in contrast with the conventional cold-cathode fluorescent lamp, there is no need to connect a nickel wire to the electricity feeding wire 5 at the position inside of the electrode 6, and the electricity feeding wire 5 may fully be composed of a Dumet wire.

Next, a mode of operation of the cold-cathode fluorescent lamp 1 and advantageous effects obtainable from the same will be described below.

Firstly, since each plate-like electrode member 6a is divided into four electrode segments while maintaining a necessary area for the electrode 6, a length L1 of each electrode 6 in the completed state can substantially be reduced to a half of that of the conventional cold-cathode fluorescent lamp. This makes it possible to reduce a non-illuminating part of the cold-cathode fluorescent lamp 1 appearing substantially in proportion to the length L1.

When the cold-cathode fluorescent lamp 1 is employed as a back-lighting unit for a liquid crystal displaying device, the whole length L2 of the cold-cathode fluorescent lamp 1 can be substantially be reduced compared with that of the conventional cold-cathode fluorescent lamp on the assumption that each of the cold-cathode fluorescent lamp and the conventional one has the same effective illuminating length, i.e., the same distance between both electrodes located opposite to each other. Consequently, the back-lighting unit can be designed and constructed with small dimensions.

Theoretically, when each plate-like electrode member 6a is divided into six electrode segments or eight electrode segments while maintaining a necessary area for the electrode 6, the length L1 of each electrode 6 can be shortened further, resulting in the length of a non-illuminating part of the cold-cathode fluorescent lamp 1 being reduced. On the contrary, a size of the electrode 6 as measured in the direction of lamination of the plate-like electrode member 6a is increased, and therefore, there arises a malfunction wherein the electrode 6 fails to be received within the range defined by the inner diameter of the tubular glass bulb 2. As a result, the dividing of the plate-like electrode member 6a into plural electrode segments in that way becomes meaningless. For this reason, it is preferable that the number of divided electrode segments is determined in such a manner that the electrode 6 is visually recognized to have a substantially square contour as viewed in the axial direction.

Secondarily, since the cold-cathode fluorescent lamp 1 is constructed in the above-described manner, the maximum size of the electrode 6 relative to the inner diameter of the tubular glass bulb 2 is located in the vicinity of the position where the electricity feeding wire 5 is spot-welded to the plate-like electrode member 6a. Thus, final dimensions defining the foregoing position can easily be controlled by properly controlling a dimensional tolerance of the plate-like electrode member 6a, a dimensional tolerance of the electricity feeding wire 5 and so forth. Thus, it becomes easy to prevent the electrodes 6 and the tubular glass bulb 2 from contacting each other after the opposite ends of the cold-cathode fluorescent lamp 1 are airtightly sealed with the beads 4, whereby there does not arise a malfunction that the tubular glass bulb 2 cracks due to the high frequency heating performed after the opposite ends of the cold-cathode fluorescent lamp 1 are airtightly sealed in that way.

Thirdly, since the cold-cathode fluorescent lamp 1 is constructed such that the fore end part of the electricity feeding wire 5 is spot-welded to the rear end part of the plate-like electrode member 6a, the electricity feeding wire 5 is not entirely associated with discharging when the cold-cathode fluorescent lamp 1 is turned on as mentioned above. This makes it possible that the whole electric feeding wire 5 is composed of a Dumet wire, resulting in the structure of the cold-cathode fluorescent lamp 1 being simplified. This means that the cold-cathode fluorescent lamp 1 can be produced at a reduced cost.

Figure 3:
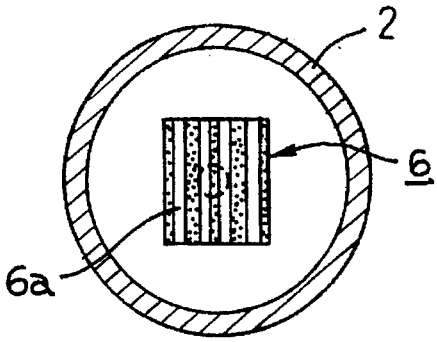
FIG. 3 is an enlarged cross-sectional view of the cold-cathode fluorescent lamp taken along line B—B in FIG. 1.

Next, FIG. 4 and FIG. 5 show a cold-cathode fluorescent lamp constructed in accordance with another embodiment of the present invention, respectively. It should be noted that same or similar components to those shown in FIG. 1 to FIG. 3 are represented by the same reference numerals.

In contrast with the preceding embodiment wherein each plate-like electrode member 6a is divided into four electrode segments each exhibiting a same contour while maintaining a necessary area for the electrode 6, in this embodiment, a width W3 of each plate-like electrode member 7b located on the outer side of each electrode 7 is dimensioned to be smaller than a width W2 of each plate-like electrode member 7a located on the inner side of the same.

As is best seen in FIG. 5, the width W2 of each plate-like electrode member 7a and the width W3 of each plate-like electrode member 7b are involved in a circle S in such a manner that the opposite ends of the plate-like electrode members 7a and 7b come in contact with the circle S. With this construction, a largest gap can be maintained between the inner wall surface of a tubular glass bulb 2 and the plate-like electrode members 7a and 7b, whereby a possibility of permitting the tubular glass bulb 2 and the electrodes 7 to come in contact with each other can substantially be reduced.

Incidentally, in this embodiment, since a mode of operation of the cold-cathode fluorescent lamp and advantageous effects obtainable from the latter are the same as those in the preceding embodiment, repeated description of them is herein omitted for the purpose of simplification.

While the present invention has been described above merely with respect to two preferred embodiments thereof, it should of course be understood that the present invention should not be limited only to these embodiments but various changes or modifications may be made without any departure away from the scope of the present invention as defined by the appended claims.

What is claimed is:

1. A cold-cathode fluorescent lamp including an opposing pair of electrodes in spaced relationship in a tubular glass bulb of which an inner wall surface is coated with a fluorescent material, comprising:

two electricity feeding wires airtightly extending through beads at opposite ends of said tubular glass bulb and terminating within said glass bulb at respective distal ends for feeding electricity to a respective electrode while holding said electrodes in said tubular glass bulb, said two electricity feeding wires defining a first axis through said tubular glass bulb, and said electrodes, each comprising four plate-like electrode members each having mercury and getter preliminarily coated thereon to serve as an electrode and spot-welded at a first end thereof to a side surface of a respective one of said electricity feeding wires at said electricity feeding wire distal end without any contact with the inner wall surface of said tubular glass bulb while maintaining a necessary area for each of said electrodes, two of said four plate-like electrode members being located on one side of said first axis, while another two being located on the opposite side of said first axis, the first end of each of said plate-like electrode members being bent toward said respective electricity feeding wire distal end for welding thereto, and an opposite second end of each of said plate-like electrode members extending into said tubular glass bulb, beyond said electricity feeding wire, and substantially parallel with said first axis.

2. The cold-cathode fluorescent lamp as claimed in claim 1, wherein each of said electrodes exhibits a substantially square contour as viewed in the axial direction.

3. The cold-cathode fluorescent lamp as claimed in claim 1, wherein each of said electricity feeding wires is fully composed of a Dumet wire.

4. A cold-cathode fluorescent lamp including an opposing pair of electrodes in spaced relationship in a tubular glass bulb of which an inner wall surface is coated with a fluorescent material, comprising;

two electricity feeding wires airtightly extending through beads at the opposite ends of said tubular glass bulb and terminating within said glass bulb at respective distal ends for feeding electricity to a respective electrode while holding said electrodes in said tubular glass bulb, said two electricity feeding wires defining a first axis through said tubular glass bulb, and said electrodes, each comprising four plate-like electrode members each having mercury and getter preliminarily coated thereon to serve as an electrode and spot welded at a first end thereof to a side surface of a respective one of said electricity feeding wires at said electricity feeding wire distal end without any contact with the inner wall surface of said tubular glass bulb while maintaining a necessary area for each of said electrodes, a first pair of said four plate-like electrode members being located on one side of said first axis and one of said first pair of plate-like electrode members located on an outer side relative to a respective electricity feeding wire having a width smaller than that of the remaining one of the first paid, while a second pair of said four plate-like electrode members being located on an opposite side of said first axis and one of said second pair of plate-like electrode members located on an outer side relative to said respective electricity feeding wire having a width smaller than that of the remaining one of the second pair, said four plate-like electrode members extending substantially in parallel not only with each other but also with each of said electricity feeding wires the first end of each of said plate-like electrode members being bent toward said respective electricity feeding wire distal end for welding thereto, and an opposite second end of each of said plate-like electrode members extending into said tubular glass bulb, beyond said electricity feeding wire, and substantially parallel with said first axis.

5. The cold-cathode fluorescent lamp as claimed in claim 4, wherein the second ends of each of said four plate-like electrode members located beyond each of said electricity feeding wires are involved within a range defined by a circle spaced away from the inner wall surface of said tubular glass bulb while coming in contact with said circle when they are viewed in an axial direction.

6. The cold-cathode fluorescent lamp as claimed in claim 4, wherein each of said electrodes exhibits a plus-mark contour as seen in axial direction.

7. The cold-cathode fluorescent lamp as claimed in claim 4, wherein each of said electricity feeding wires is fully comprised of a Dumet wire.

* * * * *

UNITED STATES PATENT AND TRADEMARK OFFICE

CERTIFICATE OF CORRECTION

PATENT NO. : 5,572,088
DATED : November 5, 1996
INVENTOR(S) : Masanobu Aizawa, et al.

It is certified that error appears in the above-indentified patent and that said Letters Patent is hereby corrected as shown below:

Column 1, lines 29-30, "in the spaced relationship", should read --in spaced relationship--.

Column 2, line 26, "95a is long,", should read --95a, is long,--.

Column 4, line 40, "same to", should read --same as--.

Column 5, line 23, "has acceptable", should read --has an acceptable--.

Column 8, claim 4, line 24, "wires", should read --wires,--.

Signed and Sealed this

Fifth Day of May, 1998

Bruce Lehman

*Attest:*

BRUCE LEHMAN

*Attesting Officer*

*Commissioner of Patents and Trademarks*